United States Patent [19]

Huntley

[11] 4,103,220

[45] Jul. 25, 1978

[54] LOW DISSIPATION VOLTAGE REGULATOR

[75] Inventor: Christopher Ryland Huntley, Burnaby, Canada

[73] Assignee: GTE Lenkurt Electric (Canada) Ltd., Burnaby, Canada

[21] Appl. No.: 784,552

[22] Filed: Apr. 4, 1977

[51] Int. Cl.[2] ..... G05F 3/08

[52] U.S. Cl. ..... 323/19; 323/22 T

[58] Field of Search ..... 307/296, 297; 323/19, 323/22 T, 22 Z, 23, 25, 39

[56] References Cited

U.S. PATENT DOCUMENTS

| | | | |
|---|---|---|---|
| 3,153,187 | 10/1964 | Klees | 323/22 T |
| 3,509,448 | 4/1970 | Bland | 323/25 X |
| 4,052,660 | 10/1977 | Shuey | 323/22 T |

*Primary Examiner*—A. D. Pellinen

*Attorney, Agent, or Firm*—Douglas M. Gilbert

[57] ABSTRACT

The disclosed voltage regulator circuit provides a regulated direct output voltage, across first and second output terminals, when an unregulated direct input voltage is applied across first and second input terminals. The second terminals are common to both input and output connections. A voltage reference device, having first and second electrodes, is connected so that the second electrode is connected to the second terminals. A first DC amplifier has an input circuit connected between the first input terminals and the first electrode, and an output circuit connected between the first output terminals and the first electrode. A second DC amplifier has an input circuit connected to the input circuit of the first DC amplifier and an output circuit connected to the output circuit of the first DC amplifier. The second DC amplifier, besides sharing the current load requirements with the first DC amplifier, also controls a bias current through the voltage reference device. The voltage reference device provides both amplifiers with a constant reference voltage enabling the amplifiers to maintain a constant output voltage despite changes in input line voltage.

2 Claims, 1 Drawing Figure

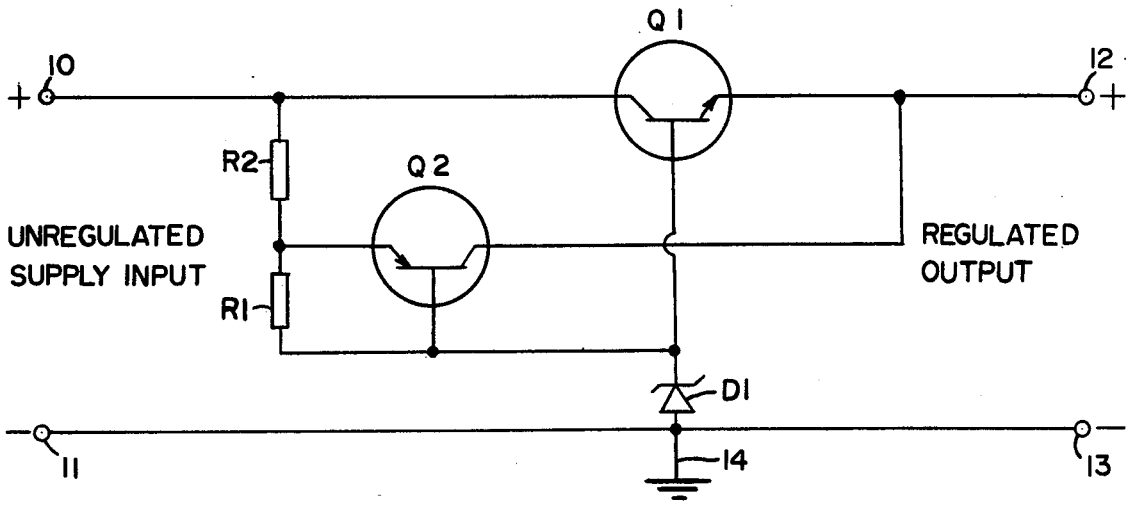
Q1
10
12
+
+
R2
Q2
UNREGULATED
SUPPLY INPUT
REGULATED
OUTPUT
R1
D1
−
−
11
14
13

LOW DISSIPATION VOLTAGE REGULATOR

BACKGROUND OF THE INVENTION

This invention relates to voltage regulator circuits and more particularly, to a series-type voltage regulator having low power dissipation.

Operationally, a series-type voltage regulator is connected between an unregulated supply line and a load. The unregulated supply line is a variable level direct voltage source having a sufficient capability to supply the direct current (DC) demands of the load. The function of a voltage regulator is to supply the load with a constant voltage (i.e. fixed level) over a wide range of current and irrespective of voltage variations in the supply line.

To understand the operation of a series-type voltage regulator consider a regulator circuit consisting of a transistor connected in a common base configuration, with a zener diode connecting the base electrode to ground, and a resistor connected across the input collector-base junction. An unregulated supply voltage would be connected between the collector electrode and ground, and a load would be connected between emitter electrode and ground. The resistor and diode form a voltage divider circuit which maintains the base circuit at some predetermined fixed potential. Since the transistor has bias current, emitter current is supplied to the load at a voltage of approximately 0.7 volts (for silicon transistors) below the base reference voltage. The output voltage will remain relatively constant irrespective of changes in input voltage. One disadvantage of this basic circuit is that the regulator power dissipation is rather high since a relatively large bias current must flow through the resistor-diode divider network. A "worst-case design", which depends on the maximum current load and the transistor $\beta$ dictates a high level of bias current. And, excessive bias current results in excessive power dissipation.

An object of this invention is to provide an improved series-voltage regulator circuit having low power dissipation.

SUMMARY OF THE INVENTION

Accordingly, the disclosed circuit provides a constant level of direct output voltages, across first and second output terminals, when an unregulated direct input voltage is applied across first and second input terminals. The second terminals are common to both input and output connections. A voltage reference device, having first and second electrodes is connected, so that the second electrode is connected to the second terminal. The first DC amplifier has an input circuit connected between the first input terminal and the first electrode, and an output circuit connected between the first output terminal and the first electrode. The second DC amplifier has an input circuit connected to the input circuit of the first DC amplifier, and an output circuit connected to the output circuit of the first DC amplifier. The second amplifier controls the bias current through the voltage reference device so that the bias current supplied is substantially independent of input voltage variations. This feature permits the second amplifier to conduct most of the amplifier bias current to the load rather than to ground, thus minimizing the overall power dissipation.

BRIEF DESCRIPTION OF THE DRAWING

The figure illustrates a schematic diagram of one embodiment of this invention.

DETAILED DESCRIPTION OF PREFERRED EMBODIMENTS

Referring now to the schematic diagram of the voltage regulator shown in FIGURE, input terminals 10 and 11 are connected to a source of unregulated supply voltage. Such a voltage source is characterized by some nominal direct voltage, $V_{IN}$, normally having some amount of level variation. The regulator circuit shown in FIGURE provides at output terminals 12 and 13, a constant level of direct output voltage, $V_{OUT}$, where $V_{OUT} < V_{IN}$. Terminals 11 and 13 are commonly connected to some reference ground potential as shown in FIGURE by terminal 14.

The regulator circuit is biased as follows. Assuming some nominal input voltage is across terminals 10 and 11 with the polarity as indicated, a bias current flows through resistors R1 and R2 and zener diode D1 to the ground potential at terminal 14. This bias current is sufficient to reverse bias the PN junction of diode D1 into a linear avalanche region of operation. As a result of the zener action, a fixed bias voltage is applied to the base of transistors Q1 and Q2. Assuming a nominal load is connected across terminals 12 and 13, both transistors Q1 and Q2 are biased into an active region, and are conducting current to the load at the regulated output voltage, $V_{OUT}$.

The extent to which transistor Q2 shares the output current load with transistor Q1 depends upon the voltage level at input terminals 10 and 11. The reason for this is as follows. With the emitter-base junction of transistor Q2 forward biased the emitter electrode will be held at 0.7V (for silicon transistors) above the reference voltage of zener diode D1. Since one end of resistor R2 is connected to the emitter electrode, the voltage drop across resistor R2 will vary with changes in input voltage, $V_{IN}$. A change in voltage across resistor R2 will cause a corresponding change in current with must be conducted through transistor Q2 (less the bias current through resistor R1).

Since resistor R1 is connected across the emitter-base junction of Q2, the voltage drop will be constant causing the current through the resistor to remain fixed. Therefore, any current fluctuations through resistor R2 must be conducted through transistor Q2 to the load connected across terminals 12 and 13. The current through transistor Q2 then depends only upon the level of input voltage as just described. In the prior art this bias current would be conducted through the resistor and zener diode to ground whereas here, the current is conducted back to the load and is not passed through the zener diode to ground. Since the level of Q2 collector current depends only upon the voltage drop across resistor R2, the value of this resistor should be chosen so that the minimum load current flows through transistor Q2 when $V_{IN}$ is at a maximum.

One feature of this curcuit results from the configuration of resistor R1 and transistor Q2. As previously described resistor R1 bridges a base-emitter junction. Since the voltage drop across the resistor is fixed, a constant current flows through the resistor. If the base current of transistors Q1 and Q2 is negligible, the current through resistor R1 becomes the bias current for diode D1. By maintaining the diode D1 bias current at a fixed level, the output voltage regulation of the entire circuit is enhanced over the prior art circuit described above. If the $\beta$ of transistor Q1 and Q2 is relatively high, then indeed the base currents will be negligible with respect to the current through resistor R1. The operating point of diode D1 will remain substantially independent of both input voltage variations and the current requirements of the output load.

Although the preceding description has assumed a positive DC supply voltage at terminals 10 and 11, certainly the regulator circuit can easily be modified to accommodate negative supply voltages. One method would be to select a PNP transistor for Q1, and NPN transistor for Q2 and to invert the connections as shown for zener diode D1.

What is claimed is:

1. A DC voltage regulator having first and second input terminals and first and second output terminals, the second input terminal and second output terminal being in common, and the output terminals having developed therebetween a constant direct output voltage unaffected by variations in direct input voltage applied between the input terminals, said regulator comprising:

a first transistor having a base, emitter and collector, the collector of the first transistor being connected to the first output terminal; a first resistor connected between the base-emitter of the first transistor; a second transistor having a base, emitter, and collector, the collector of the second transistor being connected to the first input terminal, the base of the first transistor being connnected to the base of the second transistor and the emitter of the second transistor being connected to the first output terminal; a second resistor connecting the first transistor emitter to the first input terminal; and a voltage reference device connecting the two bases to the second terminals.

2. A regulator as in claim 1 wherein said voltage reference device comprises a zener diode.

* * * * *